United States Patent [19]

Watanabe

[11] Patent Number: 5,038,894

[45] Date of Patent: Aug. 13, 1991

[54] DRIVE CONTROL APPARATUS

[75] Inventor: Eiki Watanabe, Inazawa, Japan

[73] Assignee: Mitsubishi Denki Kabushiki Kaisha, Japan

[21] Appl. No.: 427,477

[22] Filed: Oct. 27, 1989

[30] Foreign Application Priority Data

Nov. 7, 1988 [JP] Japan ..... 63-280624

[51] Int. Cl.[5] ..... B66B 11/04

[52] U.S. Cl. ..... 187/17; 187/100; 335/51

[58] Field of Search ..... 187/17, 1 R, 100, 110, 187/112; 414/606; 200/82 R; 335/285, 49, 50, 51, 47, 55

[56] References Cited

U.S. PATENT DOCUMENTS 2,570,095 10/1951 Buckler et al. ..... 335/47
2,870,285 1/1959 Rufle ..... 335/49
3,274,522 9/1966 Heller ..... 335/47
3,308,405 3/1967 Hurvitz ..... 335/55
4,292,615 9/1981 Ohashi ..... 335/51

FOREIGN PATENT DOCUMENTS 62-165185 10/1987 Japan .

*Primary Examiner*—Robert P. Olszewski
*Assistant Examiner*—Kenneth Noland
*Attorney, Agent, or Firm*—Leydig, Voit & Mayer

[57] ABSTRACT

A drive control apparatus includes a magnetic field in which a magnetic field gradient is provided by applying a magnetic field to the magnetic fluid to produce an apparent specific gravity gradient in accordance with the magnetic field gradient. A control member immersed in the magnetic fluid moves under the influence of buoyant force from a gradient of the apparent specific gravity produced in accordance with the magnetic field gradient, so that a driven body interlocking with the control member is driven at a low noise level.

11 Claims, 1 Drawing Sheet

DRIVE CONTROL APPARATUS

BACKGROUND OF THE INVENTION

1. Field of the Invention

The present invention relates to a drive control apparatus for controlling the movement of a driven body such as an elevator cage.

2. Description of the Related Art

Prior art is described below by using an example of a drive control apparatus for an elevator.

In recent years, elevators have been increasingly provided in homes with the growth of the advanced age population. Although there are various types of methods of driving such elevator cages, rope-winding drum-type drive methods or hydraulic methods are mainly used. Such methods are used in ordinary buildings and are thus not described in detail below. However, since houses are generally made of wood, in the case of a rope type drive in which a standing block is provided at the top of an elevator passage, it is necessary to strengthen the elevator passage or provide a separate steel-framed tower in order to support the load of the elevator. A hydraulic type drive is more advantageous than the rope type drive from the viewpoint of building construction, because in the hydraulic type elevator, the load is supported at the bottom of the elevator passage. However, both types employ motors to lift the elevator cage. In case of a domestic elevator which is particularly required to be silent, a great expense for reducing the noise is required. In addition, a domestic elevator is required to have an installation space which is as small as possible.

As described above, since conventional drive control apparatuses for elevators and the like employ motors and thus generate noise, and are generally used for business or industry, the apparatuses have a problem in that they are unsuitable for use in a narrow space such as a house or the like.

SUMMARY OF THE INVENTION

It is an object of the present invention to provide a drive control apparatus for elevators cage or the like which basically generates no noise and requires only a small installation space.

In a drive control apparatus in accordance with the present invention, a control member provided in a magnetic fluid is moved by changing the magnetic field applied to the magnetic fluid from the outside thereof to control the drive of a driven body interlocking with the control member.

The present invention provides a drive control apparatus for driving a body comprising a magnetic fluid having an apparent specific gravity which can be changed by in accordance with a magnetic field applied thereto, a container for receiving the magnetic fluid, a control member movable in the magnetic fluid in the container, the control member being connected to the driven body and made of a non-magnetic material, and magnetic field generating means for changing the apparent specific gravity by applying a magnetic field to the magnetic fluid and moving the control member in the container to a given position.

In the drive control apparatus of the present invention, the apparent specific gravity of the magnetic fluid is changed by changing the magnetic field applied to the magnetic fluid. This causes a change in the buoyancy applied to the control member in the magnetic fluid and thus enables the drive of the drive body which interlocks with the control member. In this way, the drive control apparatus employs no electric motor for controlling the drive of the driven body and is capable of driving the driven body without generating noise.

DESCRIPTION OF THE PREFERRED EMBODIMENTS

Figure 1:
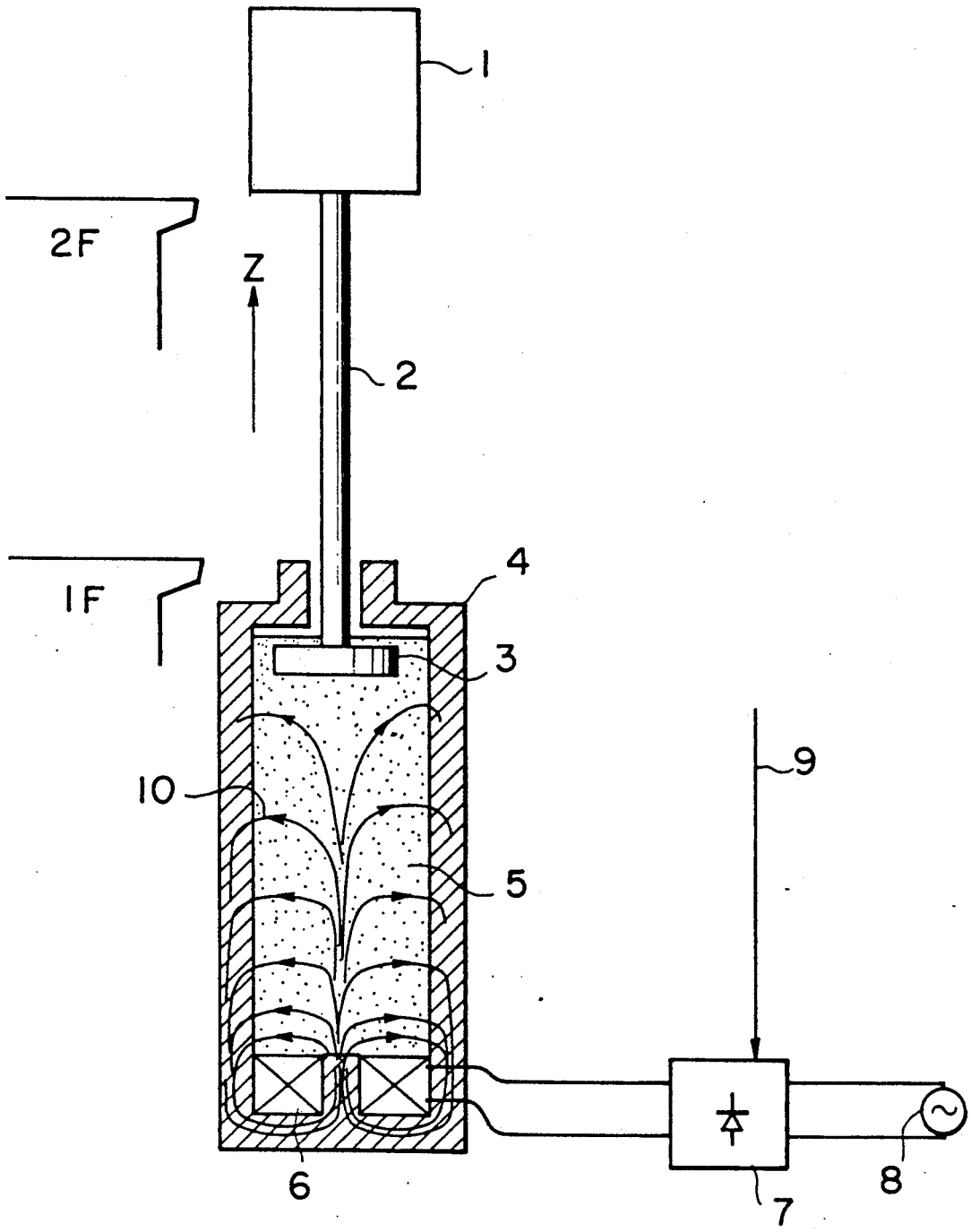
FIG. 1 is a schematic drawings of an embodiment of a drive control apparatus in accordance with the present invention.

FIG. 1 shows an embodiment of the present invention. In the drawing, a cage 1 of an elevator, which is a driven body, is supported by a plunger 2. A control member 3 made of a non-magnetic material such as copper is provided at the lower end of the plunger 2 and is movable in a cylinder 4 made of a magnetic material which serves as a container. A magnetic fluid 5 is received in the cylinder 4, and an electromagnet 6 is provided in a lower portion of the cylinder 4. A power source 8 is connected to the electromagnet 6 through a thyristor 7. The magnetization of the electromagnet 6 is controlled by controlling the thyristor 7 in accordance with the cage position signal 9 output from a position detector (not shown) which is provided on the cage 1. The control member 3 is longitudinally moved in the magnetic fluid 5 by controlling the magnetic field output from the electromagnet 6 so that the cage 1 is moved to the positions of floors 1F, 2F.

The magnetic fluid is a colloidal solution obtained by stably dispersing very fine ferromagnetic particles in an organic solvent through a surfactant, the very fine ferromagnetic particles having a size of about 100 Å. A known example of the magnetic fluid comprises magnetite $Fe_3O_4$ and an organic solvent such as kerosine or the like, which are grounded together, as well as oleic acid, ($CH_3(CH_2)_7CH{=}CH(CH_2)_7COOH$), serving as a surfactant.

The action of the apparatus of the present invention will be further described below.

When a magnetic field gradient is applied to the magnetic fluid 5 by using the electromagnet 6, the apparent specific gravity of the magnetic fluid 5 is increased, and the control member 3 is raised by buoyancy. In other words, when the electromagnet 6 is excited by the power source 8 through the thyristor 7, magnetic force lines 10 pass through the upper portion of the interior of the cylinder 4, thereby providing a magnetic field gradient to the magnetic fluid 5. At this time, the plunger 2 is slowly raised without vibrating because of the viscosity of the magnetic fluid 5. When the cage 1 reaches the second floor (2F), the electromagnet 6 controls the cage by using the signal from the cage position detector so that the floor position of the cage is not moved. In this way, since the electromagnet 6 controls the cage 1 so that the floor position of the cage 1 agrees with one of riding positions of the floors, the cage 1 can be precisely stopped at predetermined riding position even if the load (number of passengers) in the cage 1 is changed. During descent, if the magnetization of the electromagnet 6 is weakened or stopped, the cage 1 is smoothly moved downward.

A description will now be given of the apparent increase of the specific gravity of the magnetic fluid when a magnetic field is applied to the magnetic fluid. When a solid having specific gravity $\pi$ is placed in a liquid having a specific gravity $\pi 0$, the solid is subjected to a buoyancy of $\pi 0$ per unit volume. When the specific gravity $\pi$ of the solid has the following relational expression:

$$\pi 0 < \pi,$$

the solid sinks in the liquid, while when: $\pi < \pi 0$, the solid floats on the surface of liquid.

The buoyancy is created when the liquid is pulled downward by gravity, and the apparent specific gravity $\pi 1$ of the magnetic fluid is expressed by the following equation:

$$\pi 1 = \pi 0 - M/g \cdot \partial H/\partial Z$$

wherein $\pi 0$: specific gravity of the magnetic fluid,

M: strength of magnetization, g: acceleration of gravity, $\partial H/\partial Z$: magnetic field gradient in the vertical axial direction, If a magnetic field gradient is applied so that the $\partial H/\partial Z$ value is negative, the apparent specific gravity of the magnetic fluid can be increased to any value greater than the specific gravity p of the solid. For example, although the specific gravity of copper is 8.93 $g/cm^3$ and the specific gravity of the magnetic fluid is about 1 $g/cm^3$, if the value of $M/g \cdot \partial H/\partial Z$ in the above-described equation is $-8$, assuming that $\pi 0 = 1$, the apparent specific gravity $\pi 1$ of the magnetic fluid is $1-(-8)=9$, and therefore copper can be subjected to a buoyancy in the magnetic fluid.

Although the elevator system shown in FIG. 1 corresponds to, for example, a direct coupled type, in the hydraulic elevators, a side plunger type and a back plunger type may also be embodied in the same manner as the above. However, they are not described below. Further, although the above-mentioned embodiment concerns the drive control apparatus for an elevator, the drive control apparatus may be used for other driven bodies.

That is, the present invention is not limited to the above-mentioned embodiment, the scope of the idea thereof is limited by Claims.

As described above, in the drive control apparatus of the present invention, a magnetic field gradient is applied to the magnetic fluid by applying a magnetic field to the magnetic fluid from one end thereof by using the electromagnet, and the control member in the magnetic fluid is moved by a gradient of the apparent specific gravity which is produced in correspondence with the magnetic field gradient applied so that the driven body can be driven without using any electric motor. The drive control apparatus is thus capable of controlling without generating noise, and the size thereof can be reduced because of its very simple structure.

What is claimed is:

1. A drive control apparatus for lifting a load comprising:

a magnetic fluid having an apparent specific gravity which is changed by application of a magnetic field thereto;

a container for receiving said magnetic fluid therein;

a control member movable in said magnetic fluid in said container, said control member being connected to said load and made of a non-magnetic material; and magnetic field generating means for changing the apparent specific gravity of said magnetic fluid by applying a magnetic field to said magnetic fluid, thereby causing said control member to move responsive to a change in the apparent specific gravity of the fluid and lift the load.

2. A drive control apparatus according to claim 1, wherein said magnetic field generating means is provided at one end of said container to apply a magnetic field to said magnetic fluid from one side thereof, whereby a magnetic field gradient is provided in said magnetic fluid, and said control member moves in said magnetic fluid in accordance with the apparent specific gravity of said magnetic fluid produced by said magnetic field gradient.

3. A drive control apparatus according to claim 1, wherein said magnetic fluid is a colloidal solution including fine ferromagnetic particles dispersed in an organic solvent through a surfactant.

4. A drive control apparatus according to claim 3, wherein a particle size of the ferromagnetic particles is approximately 100 Å.

5. A drive control apparatus according to claim 3, wherein ferromagnetic particles are magnetite $Fe_3O_4$.

6. A drive control apparatus according to claim 3 wherein the organic solvent is kerosene.

7. A drive control apparatus according to claim 3 wherein the surfactant is oleic acid $$(CH_3(CH_2)_7CH{=}CH(CH_2)_7COOH).$$

8. A drive control apparatus for driving a driven body comprising:

a magnetic fluid having an apparent specific gravity which is changed by application of a magnetic field thereto;

a container for receiving said magnetic fluid therein;

a control member movable in said magnetic fluid in said container, said control member being connected to said driven body and made of a non-magnetic material; and magnetic field generating means for changing the apparent specific gravity of said magnetic fluid by applying a magnetic field to said magnetic fluid, thereby causing said control member to move responsive to a change in the apparent specific gravity of the fluid, said magnetic field generating means being provided at one end of said container to apply a magnetic field to said magnetic fluid from one side thereof, whereby a magnetic field gradient is provided in said magnetic fluid, and said control member moves in said magnetic fluid in accordance with the apparent specific gravity of said magnetic fluid produced by said magnetic field gradient, wherein said driven body is a cage of an elevator, and said magnetic field generating means is provided on the lower side of said container to apply a magnetic field gradient to said magnetic fluid, whereby said cage connected to said control member is moved to a desired floor in accordance with the movement of said control member in said magnetic fluid.

9. A driven control apparatus according to claim 8, wherein said magnetic field generating means comprises an electromagnet, a power source and a power control means for controlling excitation power applied to said electromagnet from said power source, said electromagnet generating a magnetic field in said magnetic fluid.

10. A drive control apparatus according to claim 9 further comprising a position detector for detecting the position of said cage and outputting a position signal, said power control means being connected to receive the position signal and controlling the excitation power applied to said electromagnet in accordance with the position signal.

11. A drive control apparatus according to claim 10, wherein said power control means is a thyristor.

* * * * *